US007517847B2

(12) United States Patent
Catalfamo et al.

(10) Patent No.: US 7,517,847 B2
(45) Date of Patent: Apr. 14, 2009

(54) BLEACHING PRODUCT COMPRISING A WATER-SOLUBLE FILM COATED WITH BLEACHING AGENTS

(75) Inventors: Vincenzo Catalfamo, Cincinnati, OH (US); Frank William Denome, Cincinnati, OH (US); Dennis Allen Beckholt, Fairfield, OH (US); Yousef Georges Aouad, Cincinnati, OH (US); James Michael Archbold, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 48 days.

(21) Appl. No.: 11/432,178

(22) Filed: May 11, 2006

(65) Prior Publication Data

US 2006/0258553 A1 Nov. 16, 2006

Related U.S. Application Data

(60) Provisional application No. 60/681,070, filed on May 13, 2005.

(51) Int. Cl.
*C11D 17/06* (2006.01)
*C11D 3/395* (2006.01)

(52) U.S. Cl. ..... 510/296; 510/276; 510/286; 510/300; 510/302; 510/309; 510/311; 510/312; 510/367; 510/375; 510/376; 510/438; 510/439; 510/441

(58) Field of Classification Search ..... 510/276, 510/286, 296, 300, 302, 309, 311, 312, 367, 510/375, 376, 438, 439, 441
See application file for complete search history.

(56) References Cited

U.S. PATENT DOCUMENTS

| | | | | |
|---|---|---|---|---|
| 4,532,063 | A * | 7/1985 | Gueldenzopf | 252/186.35 |
| 4,557,852 | A * | 12/1985 | Schulz et al. | 252/186.35 |
| 4,654,395 | A * | 3/1987 | Schulz et al. | 526/318.42 |
| 4,973,416 | A * | 11/1990 | Kennedy | 510/296 |
| 5,132,036 | A * | 7/1992 | Falou et al. | 510/277 |
| 5,160,654 | A * | 11/1992 | Falou et al. | 510/277 |
| 6,465,407 | B2 * | 10/2002 | Hayashi et al. | 510/295 |
| 6,831,051 | B2 * | 12/2004 | Sommerville-Roberts et al. | 510/296 |
| 7,229,955 | B2 * | 6/2007 | Dasque et al. | 510/296 |
| 2004/0033921 | A1 | 2/2004 | Dasque et al. | |
| 2006/0090779 | A1 * | 5/2006 | Sharma et al. | 134/146 |

FOREIGN PATENT DOCUMENTS

| | | | |
|---|---|---|---|
| EP | 0 073 541 | A | 3/1983 |
| EP | 097 158 | A | 11/1999 |

OTHER PUBLICATIONS

PCT International Search Report, 4 Pages, Mailed May 10, 2006.

* cited by examiner

*Primary Examiner*—Charles I Boyer
(74) *Attorney, Agent, or Firm*—Laura R. Grunzinger; Julie A. McConihay; Kim William Zerby

(57) ABSTRACT

Bleaching product in the form of a coated substrate comprising a water-soluble film and a coating comprising a bleaching agent.

10 Claims, No Drawings

BLEACHING PRODUCT COMPRISING A WATER-SOLUBLE FILM COATED WITH BLEACHING AGENTS

CROSS REFERENCE TO RELATED APPLICATION

This application claims priority to U.S. Provisional Application Ser. No. 60/681,070 filed May 13, 2005, the disclosure of which is incorporated by reference.

TECHNICAL FIELD

The present invention relates to a bleaching product, in particular to a bleaching product in the form of a bleaching-functionalized water-soluble film. The invention also relates to cleaning products comprising the bleaching product.

BACKGROUND OF THE INVENTION

The formulation of cleaning products comprising bleaching agents is a challenging task. Due to their oxidative capacity, bleaching agents are prone to react and destabilize sensitive ingredients such as perfumes, enzymes, etc. As a consequence it is normally necessary to take special measures to ensure the stability of the formulation comprising both the strong oxidants and the bleach sensitive ingredients. Examples of such measures are the segregation of incompatible ingredients in different phases of the formulations (i.e. in different regions of a tablet U.S. Pat. No. 5,133,892), coating one of the ingredients or maintaining it in an isolated state (i.e. by insolubilisation in a liquid matrix) to reduce its interaction with the rest of the formulation.

Problems may not only occur during the storage of the product but also during the cleaning process. When the cleaning product is placed into water and the bleaching agents are released, they can oxidise other ingredients of the cleaning product rather than act on the items to be cleaned, affecting the total efficacy of the product.

Additional problems can appear when the bleaching agent needs to be used in a determined particle size, as in the case of diacyl or tetraacyl peroxide. These kinds of peroxides, which are usually insoluble in water, perform a more efficient bleaching action when the particle size is small. The small particle size also avoids spotting and filming on the cleaned articles. The size limitation can create dusting problems during the manufacturing process, segregation problems in granular detergents and settling problems in liquid detergents.

Due to the above mentioned difficulties an unmet need remains to find a detergent product in which bleaching agent/oxidizing sensitive ingredients interaction is minimized during storage and/or during the cleaning process.

SUMMARY OF THE INVENTION

According to a first aspect of the invention, there is provided a bleaching product in the form of a bleaching-functionalized water-soluble film. The film is preferably functionalized by means of a coating comprising a bleaching agent. The coating can partially or totally cover one or both surfaces of the film. The bleaching product of the invention can have high levels of one or more bleaching agents loaded onto or carried by the water-soluble film. The thickness of the film does not limit the amount of agents that can be loaded. Preferably the coating is in a level of at least about 5, more preferably at least about 10 and especially at least about 20 g/m$^2$. Preferably the loading is at least about 30%, more preferably at least about 50%, even more preferably at least about 100% and especially at least about 200% by weight of the uncoated film. The level of the coating can further be increased by coating the two sides of the film. Preferably, the coating comprises at least about 30%, more preferably at least about 60% and even more preferably at least about 70% of bleaching agent by weight of the coating.

By "bleaching product" is meant a product whose main function is bleaching coloured substrates, soils or stains. The bleaching product releases the bleaching agent when immersed in water. The bleaching product can provide a very efficient way of quickly delivering high levels of bleaching agent in water due to the high surface area of the product.

The bleaching product of the invention can be used by itself (like a performance booster) but preferably is used as part of a cleaning product. The term "cleaning product" as used herein has a broader meaning than "bleaching product". Cleaning means the removal of dirt, including bleaching of coloured soils and stains.

In preferred embodiments the bleaching agent is selected from the group consisting of bleach, bleach activator, bleach catalyst and mixtures thereof.

The bleaching product of the invention allows the delivery of bleaching agents in the form of particles of small size (i.e. particles having a weight average diameter of less than about 200 μm, preferably less than 100 μm and even more preferably less than 50 μm), thereby increasing the specific activity of the bleaching agent. Sometimes it is difficult to use bleaching agents of small particle size in conventional detergents due to segregation, settling, dusting, etc. These problems do not occur with the bleaching product of the invention.

The bleaching product can also comprise an auxiliary agent selected from the group consisting of barrier agents, solubility modifiers, aesthetic agents and mixtures thereof.

Barrier agents can protect the film and/or the bleaching agent from the surrounding environment. This obviates the need for individually protecting bleaching agents, that usually requires a complex process. For example some of the organic bleaches, including diacyl and/or tetraacyl peroxide bleaching species may require the formation of inclusion complexes before they can be stably placed in cleaning compositions. This is not required when these bleaching agents form part of the bleaching product of the invention. Similarly inorganic bleaches sometimes require to be individually coated to improve their stability on storage. Again, this is not necessary with the product of the invention.

Solubility modifiers are substances which modify the solubility of the film and/or bleaching agents by for example delaying or accelerating its solubility or making solubility dependent of external factors such as pH, temperature, ionic strength, redox potential, etc.

In preferred embodiments the bleach is an organic bleach. It can be difficult to place an organic bleach into a cleaning composition, due to its incompatibility with other ingredients, such as enzymes, perfumes, surfactants, etc. An added complication is that organic bleach can have low solubility in water and therefore in order to improve their activity low particle sizes are required. It has also been found that if the particle size of organic bleaches is too high, undissolved residues can be found after the cleaning process. Due to the required small particle size, it is difficult to keep it stable and process it in granular or liquid compositions. None of these problems occur if the organic bleach is part of the bleaching product of the invention. In a preferred embodiment the organic bleach is a diacyl peroxide, preferably di-lauroyl peroxide, having an average weight diameter of from about 0.1 to about 30 μm.

In preferred embodiments the bleaching material comprises a second water-soluble film over the coating whereby the bleaching agent is sandwiched between the water-soluble films. This protects the bleaching agent from the surrounding environment (e.g. moisture, light) and allows the handling of the material without the bleaching agent coming into contact with the skin of the user.

In preferred embodiments the coating comprises at least two discrete regions comprising two different bleaching agents. This is especially suitable in the case in which the two bleaching agents are unstable in the presence of one another and they need to be delivered into the cleaning liquor simultaneously. Preferred executions according to these embodiments include: i) a product comprising bleach and bleach activator in separate discrete regions; ii) a product comprising bleach and bleach catalyst in separate discrete regions; and iii) a product comprising bleach catalyst and bleach activator in separate discrete regions. The area of the discrete regions can widely vary from about 0.5 to about 1600 $mm^2$. The separation between discrete regions can vary from about 0.1 to 20 mm.

According to another aspect of the invention there is provided a cleaning product comprising the bleaching product and one or more cleaning auxiliaries. Preferably the cleaning product comprises percarbonate in combination with TAED or NOBS and optionally a bleach catalyst as part of the bleaching product and/or as part of the cleaning auxiliaries.

Cleaning auxiliaries are substances which play an active role in the cleaning process, including the finishing step, ie., the rinse. Cleaning actives include substances such as surfactants (anionic, nonionic, cationic and amphoteric surfactants), builders (inorganic and organic builder substances), enzymes, special polymers (for example those having cobuilder properties, soil re-deposition prevention, finishing properties), dyes and fragrances (perfumes), without the term being restricted to these substance groups.

The bleaching product can be cut into or prepared in the form of small pieces, having a maximum linear dimension of from about 0.2 to about 100 mm, preferably from about 0.5 to about 50 mm and more preferably from about 1 to about 20 mm. The pieces can be added to powder, liquid and gel compositions. In order to provide additional protection, the cutting operation can be registered with the bleaching agent application operation so that no bleaching agent is potentially exposed on the edge of the cut pieces. This is particularly advantageous when the functionalized cut pieces are introduced in a product in liquid/gel form that can potentially react with the functional material exposed on the edge of the cut pieces.

The bleaching product is very well suited for use in unit dose cleaning products either as part of the enveloping material or as part of the contents enclosed within the enveloping material. In preferred embodiments the enveloping material is formed at least in part of bleaching-functionalized water-soluble film according to the invention. For example, a single compartment unit dose form typically has separate bottom and top layers of enveloping material, according to this embodiment one or both layers can comprise or be composed of the bleaching product of the invention. The same is true for multi-compartment unit dose forms in which top, bottom and/or any of the intermediate layers of enveloping material can comprise or be composed of the bleaching product of the invention.

In preferred embodiments one side of the film or one or more regions thereof is coated with a bleach and the other side or one or more regions thereof with a bleach activator, a bleach catalyst or mixtures thereof. One or both sides can be protected by a barrier agent or another water-soluble film to form a laminate. A two-side coated film can be part of the top or bottom layer of enveloping material in a unit dose form cleaning product. A unit dose multi-compartment cleaning product containing a powder comprising enzyme in one of the compartments and the two-side coated film as part of the middle layer of the enveloping material is preferred for use herein. This execution allows to release enzymes prior to the bleaching agent, thereby minimising their interaction and maximizing performance.

In another preferred embodiment, the enveloping material of the unit dose form comprises a first film coated with a bleach and a second film coated with a bleaching agent selected from the group of bleach activator, bleach catalyst and mixtures thereof. Preferably the two films are laminated together to form the middle layer or part thereof of the enveloping material in a multi-compartment cleaning product.

In another embodiment there is provided a unit dose form product wherein the enveloping material comprises a second water-soluble film coated with enzymes sealed to the first water-soluble film. The first film is preferably situated inwards of the second film, ie the second film will be exposed to water first and the enzyme will be release before the bleach.

DETAILED DESCRIPTION OF THE INVENTION

The present invention envisages a bleaching product comprising a bleaching-functionalized water-soluble film. Preferably, the product is in the form of a coated substrate comprising the water-soluble film and a coating comprising a bleaching agent. The invention also envisages the use of the product in cleaning products and in functionalized packaging applications. The bleaching product presents an advantageous form for introducing bleaching agents into cleaning products, reducing the interaction with incompatible ingredients, allowing sequential and control release of the bleaching agents, etc.

The bleaching agent can be deposited onto the water-soluble film by any coating method. Preferred methods include printing, spraying and painting. All these methods require the bleaching agent to be in solution or slurry form before deposition onto the film. Some of the bleaching agents, in particular organic bleach can be placed in aqueous solution before depositing onto the water-soluble film without altering its bleaching activity. Some other bleaching agents are reactive in water and therefore need to be made into a solution using non-aqueous solvents, such as organic solvents. Examples of organic solvents suitable for use herein include methanol, ethanol, propanol, isopropanol, glycerol, propylene glycol, ethylene glycol, 1,2-propanediol, sorbitol and mixtures thereof. Anhydrous solvents, ie. solvents having less than 5%, preferably less 3% of unbound water are also suitable for processing water sensitive bleaching agents.

Process

The functionalized substrate of the invention can be made by depositing a coating of a bleaching agent using suitable coating means including spraying, knife, rod, kiss, slot, painting, printing and combinations thereof. Printing is preferred for use herein, in particular flexographic (flexo) printing.

In the typical flexo printing sequence, the water-soluble film is fed into the press from a roll. The bleaching agent is printed as the film is pulled through one or more stations, or print units. Each print unit can print a solution comprising one or more bleaching materials. Each printing step on a flexo press consists of a series of four rollers or cylinders: fountain roller, meter or anilox roller, flexographic or printing cylinder and impression cylinder.

The first roller (fountain roller) transfers the printing solution comprising the bleaching agent(s) from the solution pan to the meter or anilox roller, which is the second roller. A doctor blade may be used if it is necessary to scrape some of the printing solution. The anilox roller meters the solution to a uniform thickness onto the printing cylinder. The substrate then moves between the printing cylinder and the impression cylinder, which is the fourth roller. In some flexographic equipment the fountain roller is missing and the anilox roller functions as both the fountain roller and the meter roller.

The impression cylinder applies pressure to the printing cylinder, thereby transferring the bleaching agent(s) onto the film. The printed film may be fed into an overhead dryer so the newly formed layer is dried to remove most of the residual liquid before it goes to the next print unit. The finished product is then rewound onto a roll or is fed through the cutter.

The process is suitable for depositing water-soluble materials, water-insoluble materials and mixtures thereof. In the case of water-insoluble materials is preferred to keep the printing solution agitated in the solution pan to avoid the settling of the materials(s). It is also preferred the use of structurants or thickening agents to promote the suspension of the insoluble materials in water. The coating can comprises a plurality of bleaching agents by using a solution comprising more than one bleaching agent or by using solutions comprising different agents in different printing steps.

The fountain roller does not contact the anilox roller when transferring the printing solution to reduce wear. Preferably the fountain roller is made of soft durometer rubber which is silicone coated. The softness permits the fountain roller to pick up the most aqueous solution possible. Fountain rollers are commercially available from Mid American Rubber.

Preferably a doctor blade is used to meter the printing solution to a consistent thickness on the surface of the anilox roller. Preferably the doctor blade is a ceramic coated metal blade like the one supplied by BTG, Norcross Ga.

The anilox roller includes a multiplicity of microscopic cells that are arranged in a pattern next to each other and cover the entire surface of the roller. These cells hold the printing solution. The cells typically have either a honeycomb shape or a "tri-helical" pattern. The cells can be oriented in rows that run at an angle to the longitudinal axis of the roller (so that the rows of larger sized cells appear to form screw threads around the roller).

Typical angles are 30, 45 and 60 degrees. In traditional printing different colours of inks typically are printed with cells that are oriented at different angles.

The coarseness of the anilox roller determines how much of the solution is transferred to the film. As the volume of the anilox cells increases (e.g. from 60 to 100 bcm, standing for billion parts of cube micron), at comparable cell emptying on the plate (transfer), the volume of printing solution transferred on the plate and then on the substrate increases.

Anilox rollers are often made of stainless steel. However, for some applications such as the printing of corrosive materials, (for example, organic perodixes and in particular dibenzoyl peroxide), the rollers should have a ceramic coating to prevent corrosion of the stainless steel roller. Anilox rollers are commercially available from Harper Corporation of America and Interflex.

Flexographic roller is a flexible patterned roll. The flexible plate material can be a 50 durometer, 0.067 inch thick material.

Other plates that can be used for flexographic printing include those identified at column 4, lines 30 to 45 of U.S. Pat. No. 5,458,590.

The water-soluble film can be engraved or embossed such that micro (invisible to the naked eye) or macro (visible) deformations are created in a given pattern before or in conjunction with the deposition of the printing solution. This enables larger volumes of bleaching agent to be deposited, in particular when the bleaching agent is "sandwiched" between the two laminating films thanks to the void area created by the two engraved or embossed films coming in contact. Relatively large holes can be impressed on both films and the printing solution can be applied on both films surface before laminating them together. The level of bleaching agent present between the two films is much more thanks to the voids created by joining two holes together. Embossing plates that can be used in a flexographic equipment are supplied by Trinity Graphic USA, FL. Another method of holding more bleaching agent on the film is to pre-apply a primer that forms a micro-cellular morphology (small cells) on the film. These primers are micro-cellular coatings based on polyurethane systems that can be applied via coating and printing methods and are supplied by Crompton Corporation, CT. The macro deformations can be achieved by subjecting the film to series of intermeshing ring rolls or engraving flexographic plates. Micro deformations can be either formed by engraving rolls with micro patterns or by using an hydro formed film that has protruding shapes (e.g. hallow tubes). Protruding hallow shapes can hold additional bleaching agent when in liquid or slurry form thanks to the capillary force.

It is preferred to add a structurant to the printing solution, especially if the bleaching agent is insoluble in the printing solution because the presence of the structurant helps the suspension of the bleaching agent. Preferred for use herein are polymeric structurants selected from the group consisting of polyacrylates and derivatives thereof; polysaccharides and derivatives thereof; polymer gums and combinations thereof. Polyacrylate-type structurants comprise in particular polyacrylate polymers and copolymers of acrylate and methacrylate. An example of a suitable polyacrylate type structurant is Carbopol Aqua 30 available from B.F. Goodridge Company.

Examples of polymeric gums which may be used as structurant herein can be characterized as marine plant, terrestrial plant, microbial polysaccharides and polysaccharide derivatives. Examples of marine plant gums include agar, alginates, carrageenan and furcellaran.

Examples of terrestrial plant gums include guar gum, gum arable, gum tragacenth, karaya gum, locust bean gum and pectin. Examples of microbial polysaccharides include dextran, gellan gum, rhamsan gum, welan gum and xanthan gum. Examples of polysaccharide derivatives include carboxymethyl cellulose, methyl hydroxypropyl cellulose, hydroxy propyl cellulose, hydroxyethyl cellulose, propylene glycol alginate and hydroxypropyl guar. The second structurant is preferably selected from the above list or a combination thereof. Preferred polymeric gums include pectine, alginate, arabinogalactan (gum Arabic), carrageenan, gellan gum, xanthan gum and guar gum.

If polymeric gum structurant is employed herein, a preferred material of this type is gellan gum.

Gellan gum is a tetrasaccharide repeat unit, containing glucose, glucurronic acid, glucose and rhamrose residues and is prepared by fermentation of Pseudomonaselodea ATCC 31461. Gellan gum is commercially marketed by CP Kelco U.S., Inc. under the KELCOGEL tradename.

Preferably the printing solution comprises from about 0.1 to about 20%, more preferably from about 1 to about 10% by weight of the aqueous solution of structurant.

The most preferred structurant for use herein is polyvinyl alcohol (PVA). PVA not only gives the printing solution the right viscosity to achieve high loadings but also acts as a binder to layer-up successive layers of the bleaching agent making a very strong, flake-free coating. Preferably, the level of PVA in the printing solution is from about 0.5 to about 20%, more preferably from about 1 to about 10% and especially from about 2 to about 5% by weight of the printing solution.

The printing solution is preferably an aqueous solution. By "aqueous solution" is herein meant a solution in which the solvent in major proportion is water. The solution can also comprise other solvents in minor proportions. Preferably, the water content of the solution is at least about 10%, preferably at least about 20%, more preferably at least about 30% and even more preferably at least about 40% by weight above the level of any other solvent present in the solution. Preferably, the water content of the solution is at least about 20%, more preferably at least about 30%, even more preferably at least about 40% and especially at least about 60% by weight. The term solution should be broadly interpreted for the purpose of this invention, including any mixture comprising water and functional material. Slurries and dispersions (liquid/solid), foams (liquid-gas) and emulsions (liquid/liquid) are considered to be solutions.

In the case of aqueous printing solutions the solution can comprise a film insolubilizer, ie., an agent that temporarily reduces the solubility of the film in presence of the aqueous solution at the level at which is used in the process. However, the functionalized film remains soluble when immersed in water. The film insolubilizer can be applied before the aqueous solution comprising the functional material or as part of the aqueous solution.

Film Insolubilizer Agent

Preferred insolubilizer agents for use herein are salts. Salts may include organic or inorganic electrolytes. Suitable salts may include a cation or mixtures of cations selected from the following group: aluminium, ammonium, antimony, barium, bismuth, cadmium, calcium, cesium, copper, iron, lithium, magnesium, nickel, potassium, rubidium, silver, sodium, strontium, zinc and zirconium; and an anion or mixture of anions selected from the following group: acetate, aluminium sulfate, azide, bicarbonate, bisulfite, borohydride, borooxalate, bromate, bromide, carbonate, chloride, chlorite, chromate, cyanate, cyanide, dichromate, disilicate, dithionate, ferricyanide, ferrocyanate, ferrocyanide, fluoride, fluoantimonate, fluoroborate, fluorophosphate, fluorosulfonate, flurosilicate, hydrogen carbonate, hydrogen sulfate, hydrogen sulfite, hydrogencyanide, hydrogenophosphate, hydrogensulfate, hydrosulfite, hydroxide, hydroxostannate, hypochlorite, hyponitrite, hypophosphite, iodate, iodide, manganate, meta-aluminate, metaborate, metaperiodate, metasilicate, mixed halides, molybdate, nitrate, nitrite, orthophosphate, orthophosphite, orthosilicate, oxalate, oxalatoferrate, oxide, perborate, perchlorate, permanganate, peroxide, peroxydisulfate, phosphate, polybromide, polychloride, polyfluoride, polyiodide, polyphosphate, polysulfide, pyrosulfate, pyrosulfite, sesqui-carbonate, silicate, stannate, sulfamate, sulfate, sulfide, sulfite, thiocyanaate or thiosulfate.

Other suitable salts include cations such as substituted ammonium ions R4N (with R=hydrogen or $C_{1-6}$ alkyl, substituted or unsubstituted). Other suitable types of anions include carboxylates, formate, citrate, maleate, tartrate, etc. Suitable salts may comprise $C_{1-9}$ alkyl carboxylic acids; polymeric carboxylates (polyacrylates, polymaleates); short chain ($C_{1-9}$) alkylphosphates, alkylphosphonates; and short chain ($C_{1-9}$) alkyl sulfates and alkylsulphonates.

Preferably the film insolubilizer agent is used in a level of from about 0.5 to about 10%, more preferably from about 1 to about 5% by weight of the aqueous solution. Preferably, the film insolubilising agent is a salt selected from the group consisting of: sodium sulfate, sodium citrate, sodium tripolyphosphate, potassium citrate, and mixtures thereof.

Water-soluble Film

The water-soluble film is a film made of polymeric materials and has a water-solubility of at least 50%, preferably at least 75% or even at least 95%, as measured by the method set out here after using a glass-filter with a maximum pore size of 20 microns.

50 grams±0.1 gram of film material is added in a preweighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the % solubility or dispersability can be calculated.

Preferred polymeric materials are those which are formed into a film or sheet. The film can, for example, be obtained by casting, blow-moulding, extrusion or blown extrusion of the polymeric material, as known in the art.

Preferred polymers, copolymers or derivatives thereof suitable for use as film material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the film, for example a PVA polymer, is at least 60%.

Mixtures of polymers can also be used. This may in particular be beneficial to control the mechanical and/or dissolution properties of the film, depending on the application thereof and the required needs. It may be preferred that a mixture of polymers is used, having different weight average molecular weights, for example a mixture of PVA or a copolymer thereof of a weight average molecular weight of 10,000-40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1-35% by weight polylactide and approximately from 65% to 99% by weight polyvinyl alcohol, if the material is to be water-dispersible, or water-soluble.

It may be preferred that the PVA present in the film is from 60-98% hydrolysed, preferably 80% to 90%, to improve the dissolution of the material.

Typically the water-soluble film has a basis weight from about 25 g/m$^2$ to about 150 g/m$^2$, preferably from about 50 g/m$^2$ to about 100 g/m$^2$ and a caliper from about 0.025 mm to about 0.160 mm, preferably from about 0.060 mm to about 0.130 mm.

Most preferred water-soluble films are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The water-soluble film herein may comprise other additive ingredients than the polymer or polymer material and water. For example, it may be beneficial to add plasticisers, for example glycerol, ethylene glycol, diethyleneglycol, propylene glycol, sorbitol and mixtures thereof. Glycerol is the preferred plasticisers. Other useful additives include disintegrating aids.

Bleach

Inorganic and organic bleaches are suitable bleaches for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated before depositing it onto the water-soluble film.

Alkali metal percarbonates, particularly sodium percarbonate are preferred perhydrates for inclusion in the products of the invention. The percarbonate is most preferably incorporated into the products in a coated form which provides in-product stability. A suitable coating material providing in product stability comprises mixed salt of a water-soluble alkali metal sulphate and carbonate. Such coatings together with coating processes have previously been described in GB-1,466,799. The weight ratio of the mixed salt coating material to percarbonate lies in the range from 1:200 to 1:4, more preferably from 1:99 to 19, and most preferably from 1:49 to 1:19. Preferably, the mixed salt is of sodium sulphate and sodium carbonate which has the general formula Na2S04.n.Na2CO3 wherein n is from 0.1 to 3, preferably n is from 0.3 to 1.0 and most preferably n is from 0.2 to 0.5.

Another suitable coating material providing in product stability, comprises sodium silicate Of Si02:Na20 ratio from 1.8:1 to 3.0:1, preferably L8:1 to 2.4:1, and/or sodium metasilicate, preferably applied at a level of from 2% to 10%, (normally from 3% to 5%) Of Si02 by weight of the inorganic perhydrate salt. Magnesium silicate can also be included in the coating. Coatings that contain silicate and borate salts or boric acids or other inorganics are also suitable.

Other coatings which contain waxes, oils, fatty soaps can also be used advantageously within the present invention.

Potassium peroxymonopersulfate is another inorganic perhydrate salt of utility herein.

Typical organic bleaches are organic peroxyacids including diacyl and tetraacylperoxides, especially diperoxydodecanedioc acid, diperoxytetradecanedioc acid, and diperoxyhexadecanedioc acid. Dibenzoyl peroxide and di-lauroyl peroxide are preferred organic peroxyacids herein. Mono- and diperazelaic acid, mono- and diperbrassylic acid, and Nphthaloylaminoperoxicaproic acid are also suitable herein.

The diacyl peroxide, especially dibenzoyl peroxide, should preferably be present in the form of particles having a weight average diameter of from about 0.1 to about 100 microns, preferably from about 0.5 to about 30 microns, more preferably from about 1 to about 10 microns. Preferably, at least about 25%, more preferably at least about 50%, even more preferably at least about 75%, most preferably at least about 90%, of the particles are smaller than 10 microns, preferably smaller than 6 microns. Diacyl peroxides within the above particle size range have also been found to provide better stain removal especially from plastic dishware, while minimizing undesirable deposition and filming during use in automatic dishwashing machines, than larger diacyl peroxide particles. The preferred diacyl peroxide particle size thus allows the formulator to obtain good stain removal with a low level of diacyl peroxide, which reduces deposition and filming. Conversely, as diacyl peroxide particle size increases, more diacyl peroxide is needed for good stain removal, which increases deposition on surfaces encountered during the dishwashing process.

Further typical organic bleaches include the peroxy acids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid).

Other bleaches suitable for use herein are pro-bleaches or bleaches that are formed in situ by reaction of two or more species. An example is chlorine dioxide that is made by reacting sodium chloride salt and a strong oxidizer like potassium persulphate.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 10 carbon atoms, in particular from 2 to 4 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC).

Bleach Catalyst

Bleach catalysts preferred for use herein include the manganese triazacyclononane and related complexes (U.S. Pat.

Nos. 4,246,612, 5,227,084); Co, Cu, Mn and Fe bispyridylamine and related complexes (U.S. Pat. No. 5,114,611); and pentamine acetate cobalt(III) and related complexes(U.S. Pat. No. 4,810,410). A complete description of bleach catalysts suitable for use herein can be found in WO 99/06521, pages 34, line 26 to page 40, line 16.

Cleaning Auxiliaries

Any traditional cleaning ingredients can be used in the cleaning product of the invention.

Surfactant

Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$-$C_{20}$, preferably $C_{10}$-$C_{18}$ linear or branched; cationic surfactants such as chlorine esters (U.S. Pat. Nos. 4,228,042, 4,239,660 and 4,260,529) and mono $C_6$-$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$-$C_{18}$ primary alcohols), ethoxylated-propoxylated alcohols (e.g., BASF Poly-Tergent® SLF18), epoxy-capped poly(oxyalkylated) alcohols (e.g., BASF Poly-Tergent® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$-$C_{20}$ alkyl amine oxides (preferred amine oxides for use herein include $C_{12}$ lauryldimethyl amine oxide, $C_{14}$ and $C_{16}$ hexadecyl dimethyl amine oxide), and alkyl amphocarboxylic surfactants such as Miranol™ C2M; and zwitterionic surfactants such as the betaines and sultaines; and mixtures thereof. Surfactants suitable herein are disclosed, for example, in U.S. Pat. Nos. 3,929,678, 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of the cleaning composition. Preferred surfactant for use in dishwashing cleaning products are low foaming and include low cloud point nonionic surfactants and mixtures of higher foaming surfactants with low cloud point nonionic surfactants which act as suds suppresser therefor.

Builder

Builders suitable for use in cleaning compositions herein include water-soluble builders such as citrates, carbonates and polyphosphates e.g. sodium tripolyphosphate and sodium tripolyphosphate hexahydrate, potassium tripolyphosphate and mixed sodium and potassium tripolyphosphate salts; and partially water-soluble or insoluble builders such as crystalline layered silicates (EP-A-0164514 and EP-A-0293640) and aluminosilicates inclusive of Zeolites A, B, P, X, HS and MAP. The builder is typically present at a level of from about 1% to about 80% by weight, preferably from about 10% to about 70% by weight, most preferably from about 20% to about 60% by weight of the cleaning composition.

Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Enzyme

Enzymes suitable herein include bacterial and fungal cellulases such as Carezyme and Celluzyme (Novo Nordisk A/S); peroxidases; lipases such as Amano-P (Amano Pharmaceutical Co.), M1 Lipase$^R$ and Lipomax$^R$ (Gist-Brocades) and Lipolase$^R$ and Lipolase Ultra$^R$ (Novo); cutinases; proteases such as Esperase$^R$, Alcalase$^R$, Durazym$^R$ and Savinase$^R$ (Novo) and Maxatase$^R$, Maxacal$^R$, Properase$^R$ and Maxapem$^R$ (Gist-Brocades); α and β amylases such as Purafect Ox Am$^R$ (Genencor) and Termamyl$^R$, Ban$^R$, Fungamyl$^R$, Duramyl$^R$, and Natalase$^R$ (Novo); pectinases; and mixtures thereof. Enzymes are preferably added herein as prills, granulates, or cogranulates at levels typically in the range from about 0.0001% to about 2% pure enzyme by weight of the cleaning composition.

Bleaching Agent

The cleaning composition of the invention can comprise bleaching agents in addition to those present in the bleaching product.

Low Cloud Point Non-ionic Surfactants and Suds Suppressers

The suds suppressers suitable for use herein include nonionic surfactants having a low cloud point. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360-362). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., BASF Poly-Tergent® SLF18) and epoxy-capped poly(oxyalkylated) alcohols (e.g., BASF Poly-Tergent® SLF18B series of nonionics, as described, for example, in U.S. Pat. No. 5,576,281).

Preferred low cloud point surfactants are the ether-capped poly(oxyalkylated) suds suppresser having the formula:

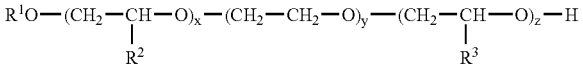

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

Other suitable components herein include organic polymers having dispersant, anti-redeposition, soil release or other detergency properties invention in levels of from about 0.1% to about 30%, preferably from about 0.5% to about 15%, most preferably from about 1% to about 10% by weight of the cleaning composition. Preferred anti-redeposition polymers herein include acrylic acid containing polymers such as Sokalan PA30, PA20, PA15, PA10 and Sokalan CP10 (BASF GmbH), Acusol 45N, 480N, 460N (Rohm and Haas), acrylic acid/maleic acid copolymers such as Sokalan CP5 and acrylic/methacrylic copolymers. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are suitable for use herein in levels generally from about 0.005% to about 20%, preferably from about 0.1% to about 10%, more preferably from about 0.25% to about 7.5% and most preferably from about 0.5% to about 5% by weight of the cleaning composition, for example diethylenetriamine penta (methylene phosphonate), ethylenediamine tetra(methylene phosphonate) hexamethylenediamine tetra(methylene phosphonate), ethylene diphosphonate, hydroxy-ethylene-1,1-diphosphonate, nitrilotriacetate, ethylenediaminotetracetate, ethylenediamine-N,N'-disuccinate in their salt and free acid forms.

The cleaning compositions herein can contain a corrosion inhibitor such as organic silver coating agents in levels of from about 0.05% to about 10%, preferably from about 0.1% to about 5% by weight of composition (especially paraffins such as Winog 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the cleaning composition.

Other suitable components herein include colorants, water-soluble bismuth compounds such as bismuth acetate and bismuth citrate at levels of from about 0.01% to about 5%, enzyme stabilizers such as calcium ion, boric acid, propylene glycol and chlorine bleach scavengers at levels of from about 0.01% to about 6%, lime soap dispersants (see WO-A-93/08877), suds suppressors (see WO-93/08876 and EP-A-0705324), polymeric dye transfer inhibiting agents, optical brighteners, perfumes, fillers and clay.

The cleaning product of the invention can be in the form of powder, liquid or gel or in unit dose form including tablets and in particular pouches, capsules and sachets.

Solubility Modifiers

Solubility modifiers modify the solubility of the water-soluble film, by for example favouring or precluding solubility below or above of a certain temperature, pH, ionic strength, pKa, redox potential, enzymatic concentration, etc. The solubility modifiers also help to achieve controlled release of the bleaching agents from the functionalized substrate.

A suitable solubility modifier is an amino-acetylated polysaccharide, preferably chitosan, having a selected degree of acetylation. The solubility of chitosan is pH dependent and the dissolution of the functionalized substrate can be restricted to a determined pH by making use of this property.

Other suitable solubility modifiers include the polymer described in WO 03/68852 which water solubility may be triggered by changes in pH, salt concentration, concentration of surfactant or a combination of both. The polymer is a copolymer or terpolymer containing from 2 to 60 mole percent of a protonated amine functionality which has been neutralized with a fixed acid. WO 02/26928 also describes suitable composite polymers that can be used for controlled release purposes, especially in dishwashing and laundry.

Additional suitable solubility modifiers that are soluble in a given pH range are based on methacrylic acid co-polymers, styrene hydroxystyrene co-polymers, acrylate co-polymers, polyethylene glycol polyvinyl acetate, diethylphtalate, dioctyl sodium sulfocuccinate, poly-dl-lactide-co-glycolide (PLG), vinylpyridine/styrene co-polymers, chitosan/lactic acid, chitosan/polyvyl acohol, commercially available from Degussa Rhom Pharma under the trade name Eudragit, from Eastman under the trade name Eastacryl, from MacroMed Inc. under the trade name SQZgel.

Solubility modifiers that are soluble in a specific chemistry environment are also commercially available. For instance caustic soluble barrier agents are commercially available from Alcoa under the trade name Hydra-Coat-5. Water dispersible barrier agent are based on Sodium starch glycolate, polyplasdone and are commercially available from FMC Corporation under the trade name Ac-di-sol, from Edward Mendell Corporation under the trade name Explotab, from ISP under the trade name Crospovidone.

Barrier Agents

Barrier agents can help to improve storage stability, in particular in a high-humidity environment and/or the feel to the touch. Suitable barrier agents include zeolite, bentonite, talc, mica, kaolin, silica, silicone, starch and cyclodextrin. Polymers, especially cellulosic materials are also suitable as barrier agent.

Other suitable barrier agents include varnish, shellac, lacquer, polyolefins, paraffins, waxes, polyacrylates, polyurethanes, polyvinyl alcohol, polyvinyl acetate, or combinations thereof. One non-limiting example of a suitable water-soluble barrier agent is an OPV (Over Print Varnish) commercially available from Sun Chemical Corporation of Charlotte, N.C. and sold as TV96-6963 water flexo film varnish.

UV absorbers may be used to protect ingredients that degrade with light. Preferred families of UV absorbers which may be used are benzophenones, salicyclates, benzotriazoles, hindered amines and alkoxy (e.g., methoxy) cinnamates and mixtures thereof. Water-soluble UV absorbers particularly useful for this application include: phenyl benzimidazole sulfonic acid (sold as Neo Heliopan, Type Hydro by Haarmann and Reimer Corp.), 2-hydroxy-4-methoxybenzophenone-5-sulfonic acid (sold as Syntase 230 by Rhone-Poulenc and Uvinul MS-40 by BASF Corp.), sodium 2,2'-dihydroxy-4,4'-dimethoxy-5-sulfobenzophenone (sold as Uvinul DS-49 by BASF Corp.), and PEG-25 paraaminobenzoic acid (sold as Uvinul P-25 by Basf Corp.). Other UV absorbers which may be used are defined in McCutcheon's Volume 2, Functional Materials, North American Edition, published by the Manufacturing Confectioner Publishing Company (1997).

According to EP 1,141,207 fluorescent dyes can also act as light protecting agents. Preferred classes of fluorescent dyes which may be used include stilbenes; coumarin and carbostyril compounds; 1,3-diphenyl-2-pyrazolines; naphthalimides; benzadyl substitution products of ethylene, phenylethylene, stilbene, thiophene; and combined heteroaromatics and mixtures thereof. Especially preferred fluorescent dyes which may be used are also the sulfonic acid salts of diamino stilbene derivatives such as taught in U.S. Pat. Nos. 2,784,220 and 2,612,510. Polymeric fluorescent whitening agent as taught in U.S. Pat. No. 5,082,578 are also suitable for use herein. Other dyes which may be used are defined in McCutcheon's Volume 2, Functional Materials, North American Edition as noted above in connection with UV absorbers.

Fluorescent dyes particularly useful for this application include: the distyrylbiphenyl types such as Tinopal CBS-X from Ciba Geigy Corp. and the cyanuric chloride/diaminostilbene types such as Tinopal AMS, DMS, 5BM, and UNPA from Ciba Geigy Corp. and Blankophor DML from Mobay.

Cleaning Product in Unit Dose Form

In a preferred embodiment of the present invention the composition is in the form of a unit dose cleaning product. It could be single or multi-compartment unit dose product, preferably a vacuum- or thermoformed multi-compartment water-soluble pouch, wherein one of the compartments, preferably contains a solid powder composition. Preferred manufacturing methods for unit dose executions are described in WO 02/42408.

Single compartment pouches can be made by placing a first piece of film in a mould, drawing the film by vacuum means to form a pocket, filling the formed pocket with a detergent or bleach including the guest-host complex, and placing and sealing the formed pocket with another piece of film.

Multi-compartment pouches comprising a powder and a liquid composition can be made by placing a first piece of film in a mould, drawing the film by vacuum means to form a pocket, pinpricking the film, dosing and tamping the powder composition, placing a second piece of film over the first pocket to form a new pocket, filling the new pocket with the liquid composition, placing a piece of film over this liquid filled pocket and sealing the three films together to form the dual compartment pouch.

EXAMPLES

Abbreviations Used in Examples

In the examples, the abbreviated component identifications have the following meanings:

Carbonate: Anhydrous sodium carbonate

STPP: Sodium tripolyphosphate

Silicate: Amorphous Sodium Silicate ($SiO_2$:$Na_2O$=from 2:1 to 4:1)

Percarbonate: Sodium percarbonate of the nominal formula $2Na_2CO_3.3H_2O_2$

Amylase: α-amylase available from Novo Nordisk A/S

Protease: protease available from Genencor

SLF18: Poly-Tergent® available from BASF

Alcosperse 240: sulfonated polymer available from Alco Chemical

DPG: dipropylene glycol

In the following examples all levels are quoted as per cent (%) by weight.

Example 1

An aqueous solution comprising 42% of benzoyl peroxide (Oxycare 42, supplied by ABCO Industries), was printed on a M8630™ 3.0 mil (100 grams per square mater basis weight) water-soluble PVA film supplied by Monosol LLC of Gary, Ind. The solution was printed on the film via a narrow web Comco flexographic printing press (commercially available from Mark Andy of Milford, Ohio), measuring 28 cm in width, having 6 stations and capable of hot air drying. Ceramic coated anilox rolls were used (supplied by Harper Corp). Fountain rolls (that pick up the aqueous solution from the pan and transfer it to the anilox roll) are supplied by Mid American Rubber, Three Rivers, Mich. Photopolymer printing plates are supplied by Du Pont (Cyrel brand). The printing took place on three of the six stations. The three sequential stations used respectively a 60 lpi (lines per inch)/40 bcm (billion cubic micron), 30 lpi/100 bcm and 30 lpi /100 bcm anilox rolls and it was allowed to dry in between the stations via convected hot air blown over the printed film surface to remove the water. The coating is in a level of 85 g/$m^2$ and the loading is 85% by weight of the uncoated film.

Example 2

A printing process as that described in example 1 is used but after the third printing station the drying step is eliminated and a second M8630™ film is placed over the wet printed film to create a laminate.

Example 3

Graphics are printed in a laminate obtained according to Example 2 using a white ink (Aqua HSX05700 manufactured by Environmental Inks and Coatings, Morgaton, N.C.).

Example 4

Graphics which change colour with temperature are printed in a laminate obtained according to Example 2 using a thermo chromic ink: Dynacolor commercially available from CTI, Colorado Springs, Colo.

Example 5

Like example 1 but using a 2 mil PVA film and an aqueous solution comprising 40% of C12-DAP (di-lauroyl peroxide) supplied by Degussa under the trade name of LP-40-SAQ. Two printing stations are used, employing respectively a 60 lpi/40 bcm and 30 lpi/100 bcm anilox rolls. The final concentration of di-lauroyl peroxide is 48 grams per square meter and 72% of the soluble film weight.

Example 6

A printing method as described in example 1 is used but a 1.5 mil (50 grams per square meter basis weight) water-soluble film supplied by Monosol LLC of Gary, Ind. is used instead and the aqueous solution contains 2.5% of PVA by weight of the solution. Two printing stations are used, employing respectively a 60 lpi/40 bcm and 30 lpi/100 bcm anilox rolls. The final concentration of benzoyl peroxide is 63 grams per square meter and 126% of the soluble film weight.

Example 7

A series of pouches comprising composition A are made as specified below.

TABLE 1

| | A |
|---|---|
| Particulate composition | |
| STPP | 40 |
| Silicate | 4 |
| Carbonate | 30 |
| Amylase | 1 |
| Protease | 2 |
| Percarbonate | 18 |
| SLF18 | 1.5 |
| Perfume | 0.2 |
| Alcosperse 240 | 3 |
| Mis/moisture to balance | |
| Liquid composition | |
| DPG | 40 |
| Glycerine | 3 |
| SLF18 | 46.6 |
| Dye | 0.8 |
| Water to balance | |

Composition A is introduced into a series of dual superposed compartment PVA rectangular base pouch. The dual compartment pouches are made from three pieces of water-soluble film (bottom, middle and top). 18 g of the solid composition and 2 g of the liquid composition are placed in the two different compartments of each pouch. Each pouch is manufactured by making an open pocket with the bottom film, filling it with the solid composition, placing the middle film over the open pocket and sealing the two films to create a new open pocket, the new pocket is filled with the liquid composition, the top film is placed over it and the new pocket is sealed giving rise to a dual compartment pouch. The films used to make the pouches are displayed in table 2.

TABLE 2

| Pouch no. | Bottom film | Middle film | Top film |
|---|---|---|---|
| 1 | From example 1 | M8630* | M8630 |
| 2 | From example 2 | M8630 | M8630 |
| 3 | M8630 | M8630 | From example 3 |
| 4 | M8630 | M8630 | From example 4 |

*Monosol M8630 film as supplied by Chris-Craft Industrial Products.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A bleaching product in the form of a coated substrate, said substrate comprising a water-soluble film having a coating on said substrate, said coating consisting essentially of a bleach and a bleach activator, wherein the coating comprises at least two separate discrete regions comprising a first discrete region comprising said bleach coating and a second discrete region comprising said bleach activator coating, wherein the discrete regions' areas are from about 0.5 to about 1600 $mm^2$ and the separation between the discrete regions is from about 0.1 to 20 mm.

2. A bleaching product according to claim 1 wherein the coating is in a level of at least 5 $g/m^2$ and a loading of at least 30% by weight of the uncoated film.

3. A bleaching product according to claim 1 wherein the bleach is an organic bleach.

4. A bleaching product according to claim 3 wherein the organic bleach is a diacyl peroxide having an average weight diameter of from about 0.1 to about 100 μm.

5. A bleaching product according to claim 1 wherein the coated substrate further comprises an auxiliary agent selected from the group consisting of barrier agents, solubility modifiers, aesthetic agents and mixtures thereof.

6. A bleaching product according to claim 1 wherein the water-soluble film or water-soluble films comprise the coating on both sides.

7. A cleaning product comprising the bleaching product according to claim 1 and one or more cleaning auxiliaries.

8. A cleaning product according to claim 7 wherein the bleaching product is in the form of pieces having a maximum length of from about 0.2 to about 100 mm.

9. A cleaning product in unit dose form comprising an enveloping material and a cleaning composition contained therein, wherein the enveloping material comprises the bleaching product of claim 1.

10. A cleaning product according to claim 9 wherein the enveloping material comprises a second water-soluble film comprising a coating comprising one or more enzymes; wherein the second water-soluble film is sealed to the first water-soluble film.

* * * * *